United States Patent [19]

Lyon et al.

[11] 4,357,818

[45] Nov. 9, 1982

[54] METHOD OF SHAPING METAL

[75] Inventors: Robert C. Lyon, Wigan; Alan J. Booton, Farnham; Francis A. Kerfoot, St. Helens, all of England

[73] Assignee: BICC Limited, London, England

[21] Appl. No.: 201,079

[22] Filed: Oct. 27, 1980

[30] Foreign Application Priority Data

Nov. 2, 1979 [GB] United Kingdom ..... 7938050
Apr. 1, 1980 [GB] United Kingdom ..... 8010903

[51] Int. Cl.[3] ..... B21D 5/14
[52] U.S. Cl. ..... 72/177; 72/187
[58] Field of Search ..... 72/176, 177, 187, 366; 428/575, 595, 603

[56] References Cited

U.S. PATENT DOCUMENTS 1,963,724 6/1934 Taylor .
2,090,706 8/1937 Sheperdson ..... 72/177
2,292,810 8/1942 Woeller ..... 72/177
3,006,401 10/1961 Wognum et al. .
3,206,965 9/1965 Gauer .
3,267,252 8/1966 Morris .
3,587,275 6/1971 Brennan .
3,690,139 9/1972 Brennan .
3,877,275 4/1975 Attwood ..... 72/177

FOREIGN PATENT DOCUMENTS 1602021 5/1970 Fed. Rep. of Germany .
1127842 9/1968 United Kingdom .
1276019 6/1972 United Kingdom .

*Primary Examiner*—Lowell A. Larson
*Attorney, Agent, or Firm*—Buell, Blenko, Ziesenheim & Beck

[57] ABSTRACT

A method of shaping metal in the form of a parallel-sided elongate sheet to make from it a formed profile that is of uniform cross-section except that at least one longitudinal edge is worked to generate a repeating pattern along its length, comprising cold working the metal sheet successively (a) by rolling to increase the width of the sheet, (b) with one or more than one knurling wheel that generates the repeating pattern in the longitudinal edge or edges of the metal sheet and at the same time reduces the width of the metal sheet to substantially its original value, and (c) by roll-forming (b) to the said profile, which may for example be a channel of substantially U-shaped cross-section.

8 Claims, 7 Drawing Figures

METHOD OF SHAPING METAL

This invention relates to a method of shaping metal in the form of a parallel-sided elongate sheet to make from it a formed profile that is of uniform cross-section except that at least one longitudinal edge is worked to generate a repeating pattern along its length.

In accordance with the present invention, the method comprises cold working the metal sheet successively (a) by rolling to increase the width of sheet, (b) with one or more than one knurling wheel that generates the repeating pattern in the longitudinal edge or edges of the metal sheet and at the same time reduces the width of the metal sheet to substantially its original value, and (c) by roll-forming to the said profile.

Preferably there are two knurling wheels, one for each longitudinal edge, and the rotation of the knurling wheels is synchronised.

Where there are more than two knurling wheels (e.g. in the case where there are four knurling wheels, two for each longitudinal edge) preferably the rotation of all the knurling wheels is synchronised.

Preferably the width of the sheet is increased by step (a) by tapering at least one longitudinal edge.

A preliminary operation prior to step (a) is preferably included in which the or each longitudinal edge of the metal sheet that is to be patterned in step (b) is pre-shaped by at least one knurling wheel.

Preferably the profile formed in step (c) is a channel of substantially U-shaped cross-section.

One important use of this method is to form a channel of the kind (for example sold by the Applicants through their subsidiary BICC Vantrunk Limited under the trade mark Leprack as Leprack Channel) having in-turned flanges with grooves at the free ends of the limbs of the channel, to which fixings are commonly made by using a rectangular nut (usually with two rounded corners) having ribs in its bearing surface that can be passed through the open slot between the in-turned flanges and then rotated through 90 degrees to engage behind those flanges, the screw then being tightened so the ribs in the nut engage the grooves in the in-turned flanges, preventing the nut moving longitudinally in the slot. This type of screw-fixing is described in our UK Patent Application Nos. 7918495 and 7921156.

This method has particular use when applied to a sheet of steel.

This invention also includes apparatus for carrying out the method as hereinbefore described.

The invention is now described with reference to the accompanying drawings in which.

Figure 1:
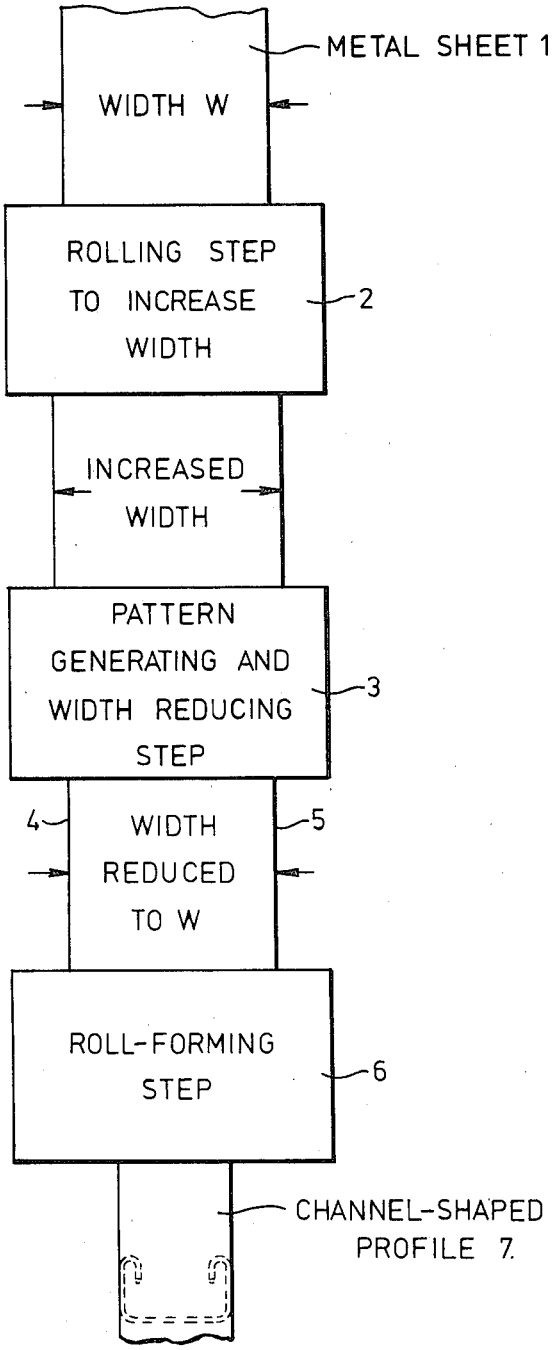
FIG. 1 is a block diagram of a method in accordance with the invention.
Figure 2:
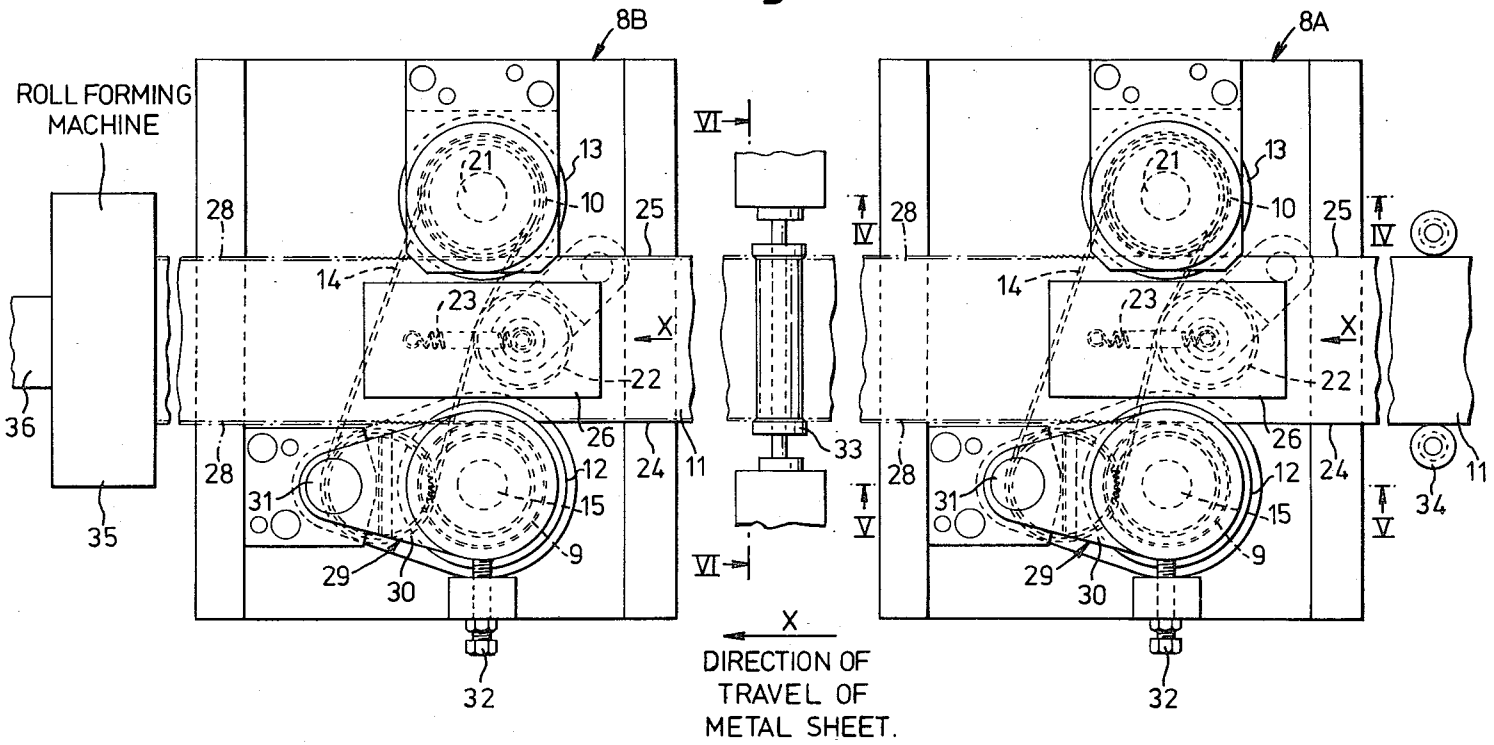
FIG. 2 is a plan view of apparatus for carrying out another method in accordance with the invention.
Figure 3:
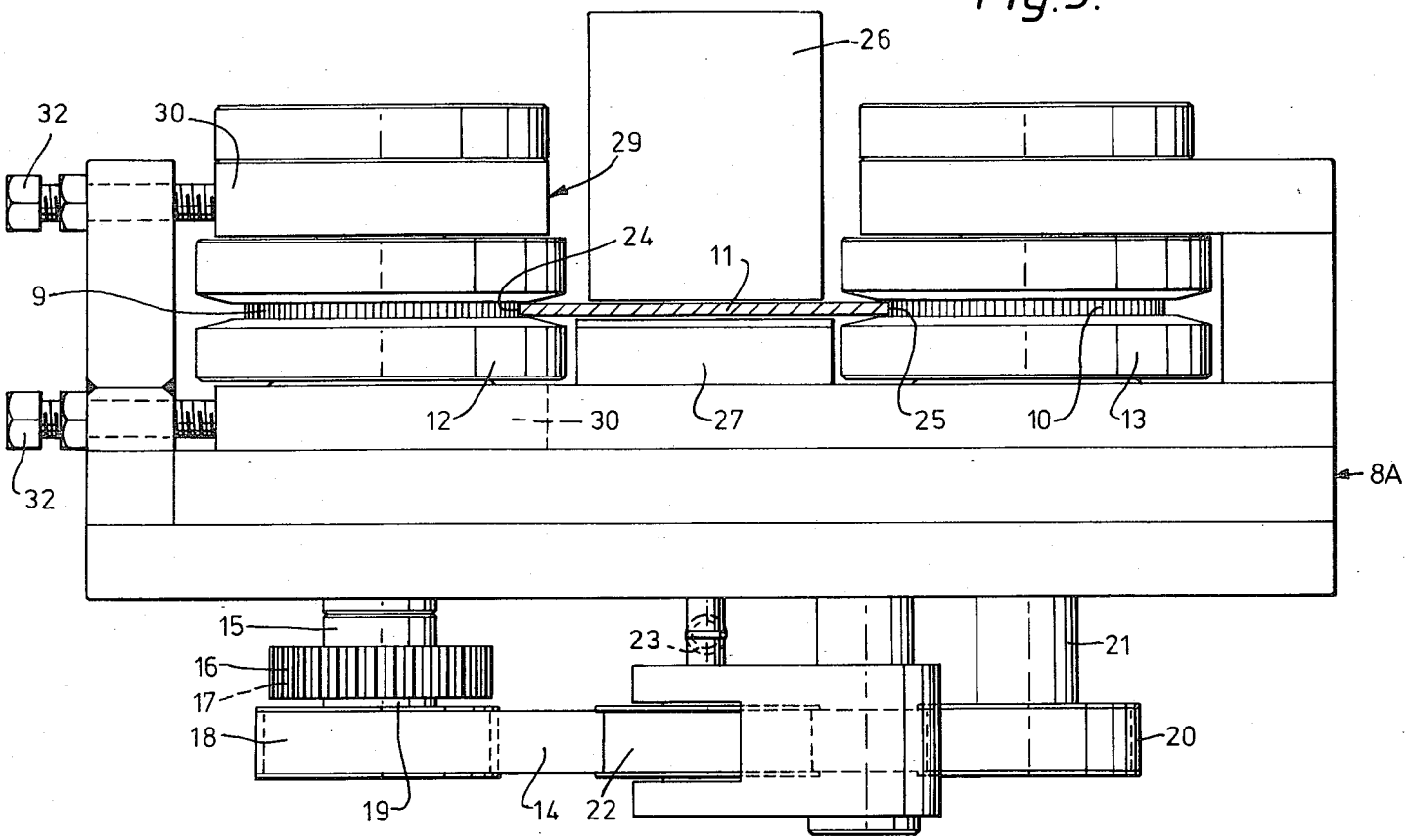
FIG. 3 is an end view of part of the apparatus shown in FIG. 2.
Figure 4:
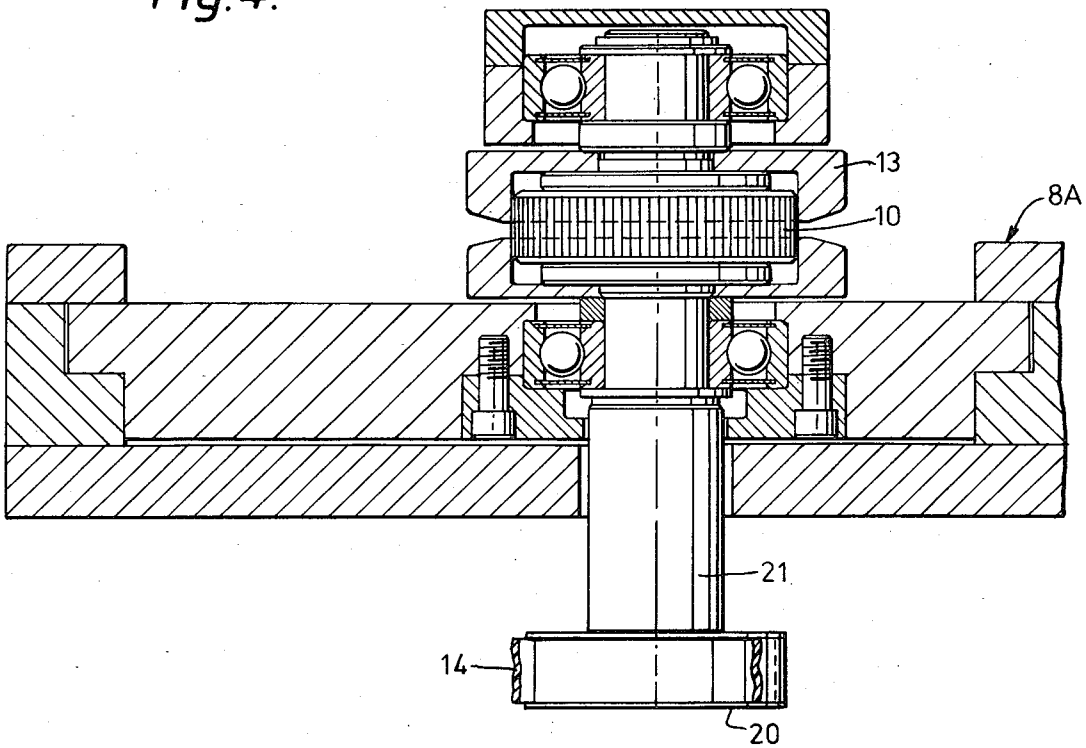
FIG. 4 is a cross-sectional view on the line IV—IV in FIG. 2.
Figure 5:
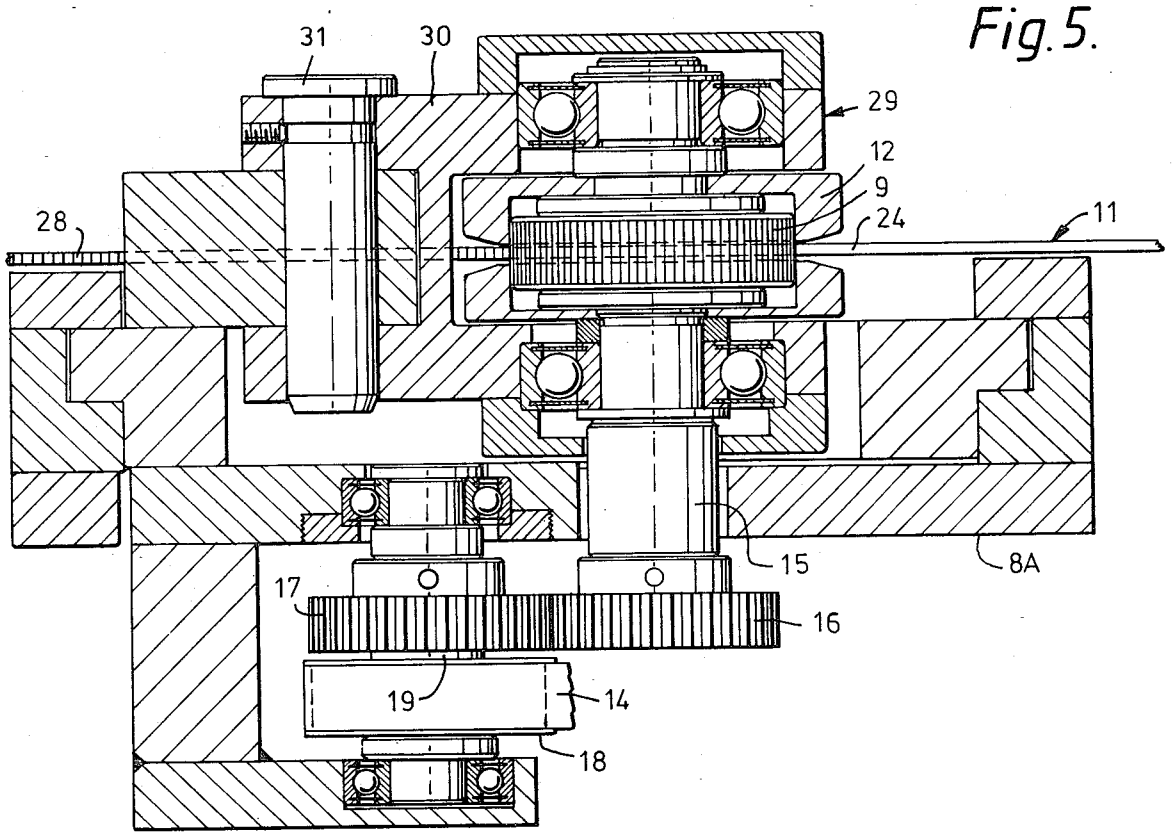
FIG. 5 is a cross-sectional view on the line V—V in FIG. 2.

In the block diagram shown in FIG. 1 a metal sheet 1, of width W, is subjected to a rolling step 2 in which the width of the metal sheet is increased, the sheet is then subjected to a pattern generating and width reducing step 3, which reduces the width of the metal sheet to substantially its original value W, and at the same time form a pattern on the longitudinal edges 4, 5 of the metal sheet. The metal sheet 1 is then subjected to a roll-forming step 6, which rolls the sheet into a channel-shaped profile 7.

Referring to FIGS. 2 to 5 of the drawings the apparatus comprises two substantially identical knurling machines 8A, 8B. Each knurling machine 8A, 8B comprises two knurling wheels 9, 10 and means for guiding a metal sheet 11 through the machine in the form of two guide wheels 12, 13 which surround the knurling wheels 9, 10. The knurling wheels 9, 10 are inter-connected by a belt 14 and pulley arrangement. One of the knurling wheels 9 is connected through its spindle 15 and a gear wheel 16 to an independent gear wheel 17. The belt 14 passes round a pulley 18 mounted on the same spindle 19 as the independent gear wheel 17, and a pulley 20 mounted on the spindle 21 of knurling wheel 10. The tension in the belt 14 is regulated by passing the belt over a roller 22 which is pulled against the belt by a spring 23.

The metal sheet 11 moves through each machine 8A, 8B in the direction X. Guide wheels 12, 13 keep the longitudinal edges 24, 25 of the sheet 11 perpendicular to the rotational axis of the knurling wheels 9, 10. Guide blocks 26, 27 prevent the metal sheet 11 buckling while it passes between the knurling wheels 9, 10. The knurling wheels 9, 10 knurl grooves 28 in the longitudinal edges 24, 25 of the metal sheet 11. The belt 14 and pulley arrangement synchronises the rotation of the two knurling wheels 9, 10 so that a groove is knurled in each longitudinal edge 24, 25 at the same time, the grooves being directly opposite.

Each machine 8A, 8B also includes an adjustor 29 for varying the separation of the knurling wheels 9, 10 allowing metal sheets of varying width to be knurled on each machine. The adjustor 29 comprises a plate 30 attached to the spindle 15 of the knurling wheel 9 and to pin 31. The knurling wheel 9 is moved by rotating adjusting screws 32 mounted on the side of each machine 8A, 8B so that the knurling wheel 9 pivots about the pin 31.

Figure 6:
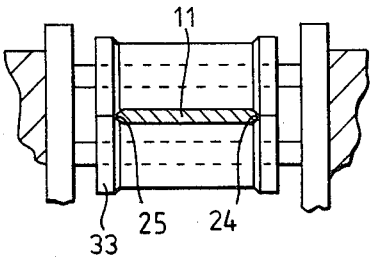
FIG. 6 is a cross-sectional view on the line VI—VI in FIG. 2.

Situated between the knurling machines 8A, 8B is a pair of rollers 33 (FIG. 6) between which the metal sheet 11 passes. The rollers 33 increase the width of the metal sheet 11 by tapering each longitudinal edge 24, 25.

Cam followers 34 are positioned at the input to the first knurling machine 8A to act as guides for the metal sheet 11.

The arrangement is such that the knurling wheels 9, 10 of the first knurling machine 8A knurl grooves 28 in the longitudinal edges 24, 25 of the metal sheet 11 to approximately half the depth required. The rollers 33 put a taper on both corners of each longitudinal edge 24, 25 and slightly increase the width, of the metal sheet 11. The knurling wheels 9, 10 of the second knurling machine 8B knurl grooves 28 of the required depth in the longitudinal edges 24, 25 and reduce the width of the metal sheet 11 to its original value.

The knurling wheels 9, 10 of the first knurling machine 8A are driven at a slightly slower rate than the rate at which the rollers 33 rotate. Therefore in use when a metal sheet 11 is fed into the apparatus the knurling wheels 9, 10 of the first knurling machine 8A initially drive the metal sheet 11 through the machine 8A until the sheet reaches the rollers 33, at which time the rollers take over and pull the sheet through the first knurling machine 8A, and drive it towards and through the second knurling machine 8B. The knurling wheels 9, 10 of the second knurling machine 8B are free-wheeling.

Figure 7:
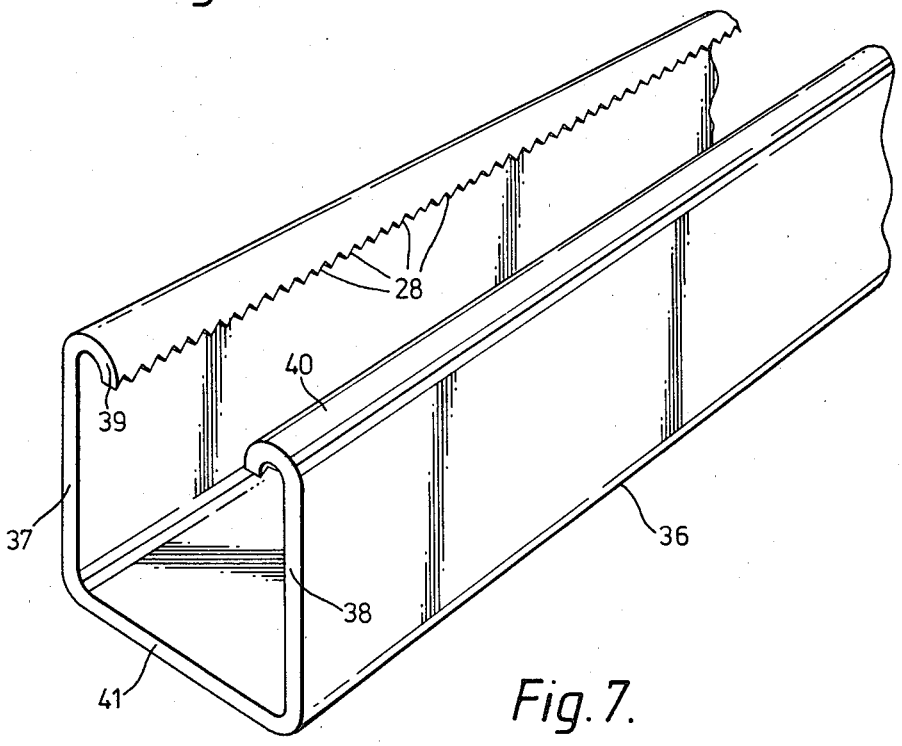
FIG. 7 is a perspective view of a channel formed by the apparatus shown in FIG. 2.

A roll-forming machine 35 is positioned at the output of the second knurling machine 8B. On passing through this machine 35 the metal sheet 11 is rolled into the profile of a channel 36 (FIG. 7) of substantially U-shaped cross-section, with the free ends of the limbs 37, 38 turned inwards to define flanges 39, 40 the grooves 28 formed by the knurling machines 8A, 8B being directed towards the base 41 of the channel.

This invention has the advantage that plain channel and channel with patterned edges can be made to the same size from the same width of strip.

Although this invention has been described for rolling a metal sheet into a channel-shape profile, this invention is not restricted to this particular arrangement, but could also be used for forming any other profile that is of uniform cross-section.

We claim:

1. A method of shaping metal in the form of an elongate sheet with parallel longitudinal edges to make from said metal sheet a formed profile that is of uniform cross-section except that at least one of said longitudinal edges is worked to generate a repeating pattern along its length comprising cold working the metal sheet by the successive steps of:

(a) rolling to increase the width of the metal sheet;

(b) with knurling wheel means (i) generating the said repeating pattern in said one longitudinal edge of the metal sheet and (ii) at the same time reducing the width of the metal sheet to substantially its original value; and (c) roll-forming to the said profile.

2. A method of shaping metal in the form of an elongate sheet with parallel longitudinal edges to make from it a formed profile that is of uniform cross-section except that each said longitudinal edge is worked to generate a repeating pattern along its length comprising cold working the metal sheet by the successive steps of:

(a) rolling to increase the width of the metal sheet;

(b) with knurling wheel means (i) generating the said repeating pattern in said longitudinal edges of the metal sheet and (ii) at the same time reducing the width of the metal sheet to substantially its original value; and (c) roll-forming to the said profile.

3. A method as claimed in claim 2, in which the rotation of the knurling wheel means acting on the said longitudinal edges of the metal sheet is synchronised.

4. A method as claimed in any one of the preceding claims in which the profile formed in step (c) is a channel of substantially U-shaped cross-section.

5. A method as claimed in any one of claims 1 to 3 in which the width of the sheet is increased in step (a) by tapering at least one of the said longitudinal edges.

6. A method as claimed in any one of claims 1 to 3 including a preliminary operation prior to step (a) in which the or each said longitudinal edge to the metal sheet that is to be patterned in step (b) is preshaped by at least one knurling wheel means.

7. A method as claimed in claim 4 in which the width of the sheet is increased in step (a) by tapering at least one of the said longitudinal edges.

8. A method as claimed in claim 4 including a preliminary operation prior to step (a) in which the or each said longitudinal edge of the metal sheet that is to be patterned in step (b) is pre-shaped by at least one knurling wheel means.

* * * * *